US011278911B2

(12) United States Patent
Yuan et al.

(10) Patent No.: US 11,278,911 B2
(45) Date of Patent: Mar. 22, 2022

(54) HIGH-VOLTAGE ELECTRIC PULSE DEVICE FOR CRUSHING PRETREATMENT OF ORES

(71) Applicant: Northeastern University, Shenyang (CN)

(72) Inventors: Shuai Yuan, Shenyang (CN); Peng Gao, Shenyang (CN); Yuexin Han, Shenyang (CN); Yanjun Li, Shenyang (CN); Liren Han, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 186 days.

(21) Appl. No.: 16/765,279

(22) PCT Filed: Jul. 16, 2019

(86) PCT No.: PCT/CN2019/096124
§ 371 (c)(1),
(2) Date: May 19, 2020

(87) PCT Pub. No.: WO2021/003758
PCT Pub. Date: Jan. 14, 2021

(65) Prior Publication Data

US 2021/0094043 A1 Apr. 1, 2021

(30) Foreign Application Priority Data

Jul. 5, 2019 (CN) ..... 201910603338.9

(51) Int. Cl.
*B02C 19/18* (2006.01)
*B02C 23/16* (2006.01)

(52) U.S. Cl.
CPC ..... *B02C 19/18* (2013.01); *B02C 23/16* (2013.01); *B02C 2019/183* (2013.01); *B02C 2023/165* (2013.01)

(58) Field of Classification Search
CPC ..... B02C 19/18; B02C 19/183; B02C 23/16; B02C 23/10
See application file for complete search history.

(56) References Cited

U.S. PATENT DOCUMENTS 3,208,674 A * 9/1965 Bailey ..... F42D 3/04 241/1
5,842,650 A * 12/1998 Hofmann ..... B29B 17/02 241/1

(Continued)

FOREIGN PATENT DOCUMENTS

CN 101676036 A 3/2010
CN 104984807 A 10/2015

(Continued)

*Primary Examiner* — Faye Francis
(74) *Attorney, Agent, or Firm* — Muncy, Geissler, Olds & Lowe, P.C.

(57) ABSTRACT

A high-voltage electric pulse device for crushing pretreatment of ores includes an ore feeding bin, a pulse insulating barrel body, a supporting frame, a pulsation device, a product collector and a power supply. The pulse insulating barrel body and the pulsation device are assembled together, a pulsation insulating barrel body is connected with an actuating diaphragm, the actuating diaphragm is connected with an ore discharging outlet, a pulsation cone is arranged in the ore discharging outlet, the pulsation cone is hinged to a connecting rod, and the connecting rod is hinged to an eccentric wheel. Expanding and contracting devices are arranged on a cover plate, a copper bar of each expanding and contracting device is connected to a corresponding high-voltage ceramic capacitor through a high-voltage wire in parallel. A high-voltage negative pole is mounted on a screen cloth at the pulse insulating barrel body.

10 Claims, 8 Drawing Sheets

(56) References Cited

U.S. PATENT DOCUMENTS 6,039,274 A * 3/2000 Zinoviev ..... B02C 19/18 241/1
7,677,486 B2 * 3/2010 Hoppe ..... B02C 19/18 241/301
8,002,209 B2 * 8/2011 Frey ..... B02C 23/12 241/1
2004/0026548 A1 * 2/2004 Okazaki ..... E21C 37/18 241/301
2005/0124842 A1 * 6/2005 Paris ..... C10J 3/18 588/1
2006/0163392 A1 * 7/2006 Hoppe ..... B02C 19/18 241/1
2007/0187539 A1 * 8/2007 Hoppe ..... B02C 19/18 241/301
2008/0283639 A1 * 11/2008 Frey ..... B02C 23/12 241/20
2012/0205472 A1 * 8/2012 Bentaj ..... B02C 19/18 241/1
2015/0069153 A1 * 3/2015 Ahlqvist Jeanneret ..... B02C 23/06 241/1
2016/0082402 A1 * 3/2016 Kitada ..... B01F 13/0003 241/1
2018/0006468 A1 * 1/2018 Kappeler ..... H02J 7/00
2018/0043368 A1 * 2/2018 Muller-Siebert ..... B02C 23/12
2018/0353968 A1 * 12/2018 Weh ..... B02C 23/36
2019/0374955 A1 * 12/2019 Ibaragi ..... C01B 33/02

FOREIGN PATENT DOCUMENTS

CN 106824454 A 6/2017
CN 106824455 A 6/2017
CN 106944223 A 7/2017
GB 2 421 203 A 6/2006
WO WO-99/03588 A1 1/1999

* cited by examiner

HIGH-VOLTAGE ELECTRIC PULSE DEVICE FOR CRUSHING PRETREATMENT OF ORES

BACKGROUND OF THE INVENTION

1. Field of the Invention

The present invention in general relates to a device for mineral processing, and more particularly, to provide a high-voltage electric pulse device for crushing pretreatment of ores.

2. The Prior Arts

In China, nonferrous mineral resources have the characteristics of being deficient, thin and sundry, for example, few single lead-zinc enriched ores exist, many low-grade ores and paragenetic ores exist and disseminated granularity is small; traditional scheelite is easy in argillation in the ore grinding process, has similar surface chemistry properties with gangue minerals, has similar floatability with the gangue minerals, and is high in grading difficulty; therefore, the ore dressing work of nonferrous ores in China has a lot of problems of being high in difficulty, low in efficiency, high in cost and the like; wherein the most important problem in the ore crushing field is that investment and maintenance cost of crushing and ore grinding equipment is very high, the energy consumption is high, overmany fine-granule-grade ores which cannot be treated and coarse-granule-grade ores being inadequate in disaggregation are produced, and the difficulty of subsequent grading operations is increased.

At present, crushing methods used in industry primarily include mechanical crushing; in respect of traditional ore comminution, ores are smashed and corroded mainly through mechanical energy impacting, shearing and grinding to achieve the purpose of dissociating mineral monomers, the crushing mechanism determines that most of the ores are crushed mainly through transcrystalline crushing, and useful minerals and the gangue minerals cannot be effectively separated; and along with decrease of ore mechanical comminuting granularity, the quantity of target minerals subjected to monomer dissociation is larger and larger, but the recovery capacity of a sorting method for the target minerals is declined along with the decrease of dissociation granularity.

SUMMARY OF THE INVENTION

In accordance with defects existing in a conventional mechanical crushing technique, a primary objective of the present invention is to provide a high-voltage electric pulse device for crushing pretreatment of ores. Through the characteristic that the useful minerals and the gangue minerals in metallic ores have large differences in electrical properties of dielectric constant, electrical conductivity and the like, a combined structure of expanding and contracting devices, tip-shaped high-voltage negative poles, a screen cloth and a pulsation ore discharging device is used, the ores are selectively crushed, the quantity of the useful minerals subjected to monomer dissociation in crushed products can meet the demand of subsequent technologies, and the energy consumption of subsequent treatment is reduced.

To achieve the above objectives, the present invention provides a high-voltage electric pulse device for crushing pretreatment of ores comprises an ore feeding bin, a pulse insulating barrel body, a supporting frame, a pulsation device, a product collector and a power supply.

An upper part of the pulse insulating barrel body is in a shape of a cylinder, a lower part of the pulse insulating barrel body is in a shape of an inverted truncated cone, a cover plate is arranged at a top portion of the pulse insulating barrel body, and a channel is arranged on the cover plate to communicate with the ore feeding bin.

The supporting frame is sleeved on a side wall of the pulse insulating barrel body, and a bottom portion of the pulse insulating barrel body and the pulsation device are assembled together.

The pulsation device consists of a pulsation insulating barrel body, an actuating diaphragm, an ore discharging outlet, a pulsation cone, a connecting rod and an eccentric wheel, wherein a water inlet is formed in a side wall of the pulsation insulating barrel body and communicates with a water pump, a bottom portion of the pulsation insulating barrel body is connected with a top portion of the actuating diaphragm, a bottom portion of the actuating diaphragm is connected with the ore discharging outlet, the pulsation cone is arranged in the ore discharging outlet, a bottom portion of the pulsation cone is hinged to one end of the connecting rod, the other end of the connecting rod is hinged to the eccentric wheel, the eccentric wheel is driven by a motor, and the actuating diaphragm is made of rubber; the ore discharging outlet communicates with a feeding inlet of the product collector, and a water outlet is formed in a side wall of the product collector.

A plurality of expanding and contracting devices are arranged on the cover plate, wherein each expanding and contracting device consists of a copper bar, a high-voltage electrode, an upper fixing block, a lower fixing block and a spring, each upper fixing block is fixedly connected to an upper part of the corresponding copper bar, the lower fixing blocks are fixed to the cover plate, each copper bar penetrates through the corresponding lower fixing block and is in sliding and sealing connection with the corresponding lower fixing block, each high-voltage electrode is fixedly connected with a bottom portion of the corresponding copper bar, a top end of each spring is fixedly connected with the corresponding lower fixing block, a bottom end of each spring is fixedly connected with the corresponding high-voltage electrode, and each spring surrounds an outer part of the corresponding copper bar.

The copper bars of the expanding and contracting devices are connected to two sets of high-voltage ceramic capacitors in parallel through high-voltage wires, the high-voltage ceramic capacitors and an alternate-current ignition transformer are assembled together, and the alternate-current ignition transformer and the power supply are assembled together through a one-way voltage regulator.

A ground electrode is fixedly connected to a bottom end of the pulse insulating barrel body, and penetrates through the supporting frame to be earthed.

A screen cloth is fixedly mounted at a bottom end of the cylinder-shaped upper part of the pulse insulating barrel body, and a plurality of high-voltage negative poles are mounted on the screen cloth.

In the device, a central axis of the eccentric wheel and the motor are assembled together, and a position where the connecting rod is hinged to the eccentric wheel is located at a part except the central axis.

In the device, a water inlet of the water pump communicates with a water outlet of a water tank, and a water inlet of the water tank communicates with the water outlet in the side wall of the product collector.

The pulse insulating barrel body is made of PVC, and the supporting frame and the cover plate are made of stainless steel.

The screen cloth is made of stainless steel, and a hole diameter of the screen cloth is 2-10 mm.

The high-voltage electrodes and the high-voltage negative poles are made of stainless steel, the high-voltage electrodes are in a shape of an inverted cone, and the high-voltage negative poles are in a shape of a cone.

In the device, the lower fixing blocks and the cover plate are insulated through insulating washers.

A discharging outlet of the ore feeding bin communicates with a lower part of the cover plate, and a valve is formed in a feeding inlet of the ore feeding bin.

An inclined screen cloth is arranged in the product collector, an inclined angle between the inclined screen cloth and a level surface is 20-40 degrees, the inclined screen cloth is located above the water outlet in the side wall of the product collector, and a hole diameter of the inclined screen cloth is 2-10 mm.

The pulsation insulating barrel body is made of PVC.

The springs are compression springs, and a length of each spring under a natural state is greater than a distance between each high-voltage electrode and the corresponding lower fixing block.

A use method of the high-voltage electric pulse device for crushing pretreatment of ores disclosed by the present invention is performed according to the following steps that:

step 1: the water pump is started, so that water continuously enters the pulsation insulating barrel body of the pulsation device and is continuously drained from the water outlet of the product collector, the pulsation insulating barrel body and the product collector are full of the water which is used as insulating liquid, and the liquid level is higher than a bottom end of the high-voltage electrodes;

step 2: the ores are placed in the ore feeding bin and are conveyed into the pulse insulating barrel body through the ore feeding bin, the ores are accumulated on the screen cloth, and the ores at the top are in contact with the high-voltage electrodes;

step 3: the power supply is switched on, electric currents are subjected to voltage transformation through a single-phase voltage regulator, voltage boosting through the alternate-current ignition transformer and rectification and voltage boosting through voltage sextuple rectifying circuits of the high voltage ceramic capacitors, then high-voltage direct currents are outputted to charge high-voltage ceramic capacitors, after the voltage of the high-voltage ceramic capacitors reaches a breakdown voltage value, a gas switch connected with the high-voltage ceramic capacitors is conducted, high-voltage electric pulse is outputted, is loaded to copper bars through high-voltage wires and is conducted to the high-voltage electrodes, and an instantaneous high-voltage electric field is formed between the high-voltage electrodes and the high-voltage negative poles; when the voltage of the high-voltage electrodes reaches to the breakdown voltage value, electric discharge is caused between the high-voltage electrodes and the high-voltage negative poles, and the ores are crushed; when the voltage of the high-voltage electrodes reaches the breakdown voltage value once again, next-time electric discharge is formed; and when the hole diameter of granules of the crushed ores are smaller than that of the screen cloth, the crushed ores enter the pulsation device through the screen cloth;

step 4: the eccentric wheel is driven by the motor to rotate, so that the pulsation cone moves up and down periodically; when the pulsation cone moves upwards, ascending water currents are formed in the pulsation device, and when the pulsation cone moves downwards, descending water currents are formed in the pulsation device; and under the action of ascending and descending of the water currents on the ores on the screen cloth, the part of the ores being small and medium in granules on the screen cloth can gradually move downwards; and step 5: the crushed ores enter the product collector through the pulsation device.

In the method, along with discharge of the crushed ores from the screen cloth, the ores on the screen cloth are gradually reduced; each high-voltage electrode is gradually declined under the action of the elasticity of the corresponding spring until the corresponding upper fixing block is in contact with the corresponding lower fixing block, at this moment, a gap is formed between each high-voltage electrode and the corresponding high-voltage negative pole, and short circuit is avoided.

In the method, the time interval of electric discharge for two close times is an electric discharge period, and the pulsation cone moves up and down once to form a pulsation period; through adjusting the rotational speed of the motor, the pulsation period is controlled to be equal to the positive integer times of the electric discharge period; and the electric discharge period is changed along with first-class input voltage and sphere gap spacing, wherein the first-class input voltage is 45-90 V, the sphere gap spacing is 15-30 mm, the pulse number of times per minute is 5-45, and the electric discharge period is ⅕-1/45 min.

The voltage of the power supply is 220 V, and the frequency of the power supply is 50 Hz.

A pulse power supply consists of the single-phase voltage regulator, the alternate-current ignition transformer and the high-voltage ceramic capacitors and is used for outputting electrical pulse, the rising time of the electrical pulse is 50 ns-500 ns, and the rising time is the time that pulse forms wave shapes.

The high-voltage negative poles are uniformly distributed on the screen cloth and are used for improving electric crushing efficiency and strengthening crushing effects.

The breakdown voltage value is 20 kV.

The pulsation device drives water and enables the actuating diaphragm to produce alternate expansion and contraction, ascending and descending water currents are formed alternately in the pulsation device and the pulse insulating barrel body, mineral grains conforming to granule diameter are timely dispersed through the ascending water currents, and ore discharge is performed through the descending water currents, so that the crushing efficiency is improved, and over crushing is avoided.

In the method, electric discharge occurs in the ores, and when the rising time is smaller than $10^{-5}$ seconds, under the action of nanosecond-level pulse, with the water as the insulating liquid, the insulating strength is larger than that of the ores, so that a plasma channel is repeatedly formed along the interfaces of useful minerals and the gangue minerals in large-granule ores; the crushed small-granule ores fall into the lower part of the pulse insulating barrel body though the high-voltage negative poles, due to water current chromatography influence of the pulse device, the small-granule ores preferentially sink to the bottom, are discharged out through the pulsation device, enter the product collector and are subjected to solid-liquid separation and the like for continuous use during subsequent crushing and ore grinding operations; and the final size of the granules depends on the hole size of the hole of the screen cloth, and the hole size of the hole of the screen cloth is adjusted as needed.

In the method, when the rising time is smaller than $10^{-5}$ seconds, under the action of the nanosecond-level pulse, the insulating strength of the water is greater than that of the ores, so that the water can be used as insulating liquid; in the process of electric discharge, the electric discharge channel easily develops along the mineral interface, generates plasma explosion, thermal stress expansion and the like on the mineral interface, further forms shock waves and destructive power fields to lead to production and extension of crackles, and finally causes macroscopic rupture of the ores; through high-voltage electric pulse crushing, the ores can be crushed, besides, extended crackles and cracks are produced on the mineral interfaces in the ores, and further the mineral cleavage and sorting characteristics are improved; promoting the development of electrical pulse equipment has important strategic significance, on the basis of guaranteeing the quality of the useful minerals, the operating cost of enterprises is saved, resource waste is reduced, the firmest basic guarantee is provided for long-term development and strong competition of the enterprises, and the electrical pulse equipment can gain a place in the ever-changing industry competition.

Compared with a traditional sample crushing method, the high-selectivity crushing method has many advantages: the treatment time is short, the production efficiency is high, and the energy consumption is low; a pulse ore discharging device is arranged, and compared with crushing equipment having the same power, the treatment capacity is hopefully increased by 1.5-2 times; in a manner of performing crushing along a crystal boundary, production and development of microcracks at the crystal boundary are promoted, selective crushing is promoted, further the mineral cleavage characteristic is improved, and the crystal form of the minerals is not destroyed; cleaning is easy, and cross contamination does not exist; after high-voltage electric pulse crushing is performed, the strength of the ores can be greatly reduced, and the ore grinding energy consumption is expected to be reduced by 30% or above; and the monomer dissociation of the useful minerals is greatly increased, and increase of ore sorting indexes is facilitated.

According to the method disclosed by the present invention, ore discharge can be performed timely, and an invalid electric crushing process is omitted, so that the treatment efficiency is improved; through self-service expanding and contracting devices, point-surface contact of the high-voltage electrodes and the ores can be guaranteed, waste of energy can be greatly reduced, the energy loss is low, the production of the electric charge channel is guaranteed, and the utilization rate of energy resources is increased; the tip-shaped high-voltage negative poles are combined with the screen cloth, so that the space is saved, and besides, the electric pulse crushing efficiency is improved; high-voltage electric pulse electric discharge crushing equipment is used for performing selective crushing on the ores, so that the content of the useful minerals of crushed products can be increased, the monomer dissociation of the crushed products is increased, reduction of the energy consumption in subsequent treatment working procedures is facilitated, and the cost of the enterprises is saved.

DETAILED DESCRIPTION OF THE PREFERRED EMBODIMENT

Figure 1:
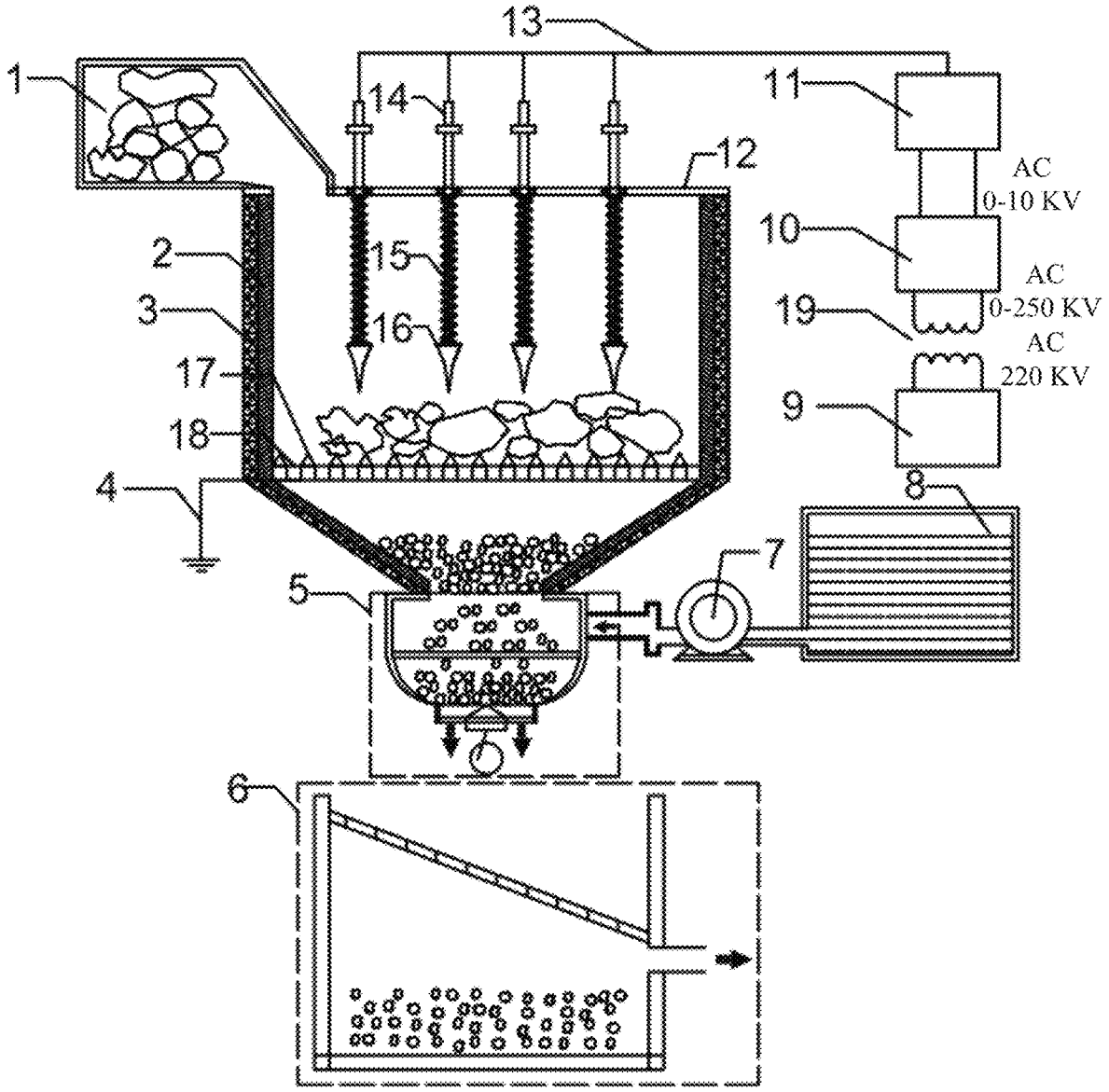
FIG. 1 is a structural schematic diagram illustrating a high-voltage electric pulse device for crushing pretreatment of ores according to an embodiment of the present invention.

The accompanying drawings are included to provide a further understanding of the invention, and are incorporated in and constitute a part of this specification. The drawings illustrate embodiments of the invention and, together with the description, serve to explain the principles of the invention.

The high-voltage electric pulse device for crushing pretreatment of ores disclosed by the present invention is further illustrated by combining with the embodiment.

The copper bars, the springs, the lower fixing blocks and the upper fixing blocks used in the embodiment of the present invention are externally coated with an insulating layer so as to prevent non high-voltage electrode parts from producing high-voltage environment and avoid waste of electric energy.

In the embodiment of the present invention, a rubber washer is arranged between the lower part of each spring and the top portion of the corresponding high-voltage electrode to be used for preventing the insulating layer from being worn and torn to cause safety accidents.

In the embodiment of the present invention, the high-voltage negative poles are uniformly arrayed into multiple rows on the screen cloth, a distance between every two adjacent high-voltage negative poles in each row is the same, a distance between every two adjacent rows of the high-voltage negative poles is the same, the high-voltage negative poles in every two adjacent rows of the high-voltage negative poles are in staggered arrangement, the number of the high-voltage negative poles in each row is at least 10, and at least 10 rows exist in total.

In the embodiment of the present invention, the number of the high-voltage electrodes is at least 5, the high-voltage electrodes are uniformly distributed on the cover plate, and the high-voltage electrodes are distributed in one or more rows, or distributed in one or more rings.

In the embodiment of the present invention, water is stored in the water tank, the water outlet of the water tank communicates with the water inlet of the water pump, and the water inlet of the water tank communicates with the water outlet of the product collector.

According to the embodiment of the present invention, when the high-voltage electric pulse is outputted, the pulse strength is 60-800 kV, and the pulse frequency is 15-25 Hz.

According to the embodiment of the present invention, the pulse insulating barrel body is made of PVC, and the supporting frame and the cover plate are made of stainless steel.

According to the embodiment of the present invention, the screen cloth is made of stainless steel, and the hole diameter of the screen cloth is 2-10 mm.

According to the embodiment of the present invention, the high-voltage electrodes and the high-voltage negative poles are made of stainless steel, the high-voltage electrodes are in a shape of an inverted cone, and the high-voltage negative poles are in a shape of a cone.

According to the embodiment of the present invention, the lower fixing blocks and the cover plate are insulated through insulating washers.

According to the embodiment of the present invention, the discharging outlet of the ore feeding bin communicates with the lower part of the cover plate, and a valve is arranged at the feeding inlet of the ore feeding bin.

According to the embodiment of the present invention, the inclined screen cloth is arranged in the product collector, an inclined angle between the inclined screen cloth and the level surface is 20-40 degrees, the inclined screen cloth is located above the water outlet in the side wall of the product collector, and the hole diameter of the inclined screen cloth is 2-10 mm.

The wall thickness of the actuating diaphragm in the embodiment of the present invention is 15-20 mm.

Figure 7:
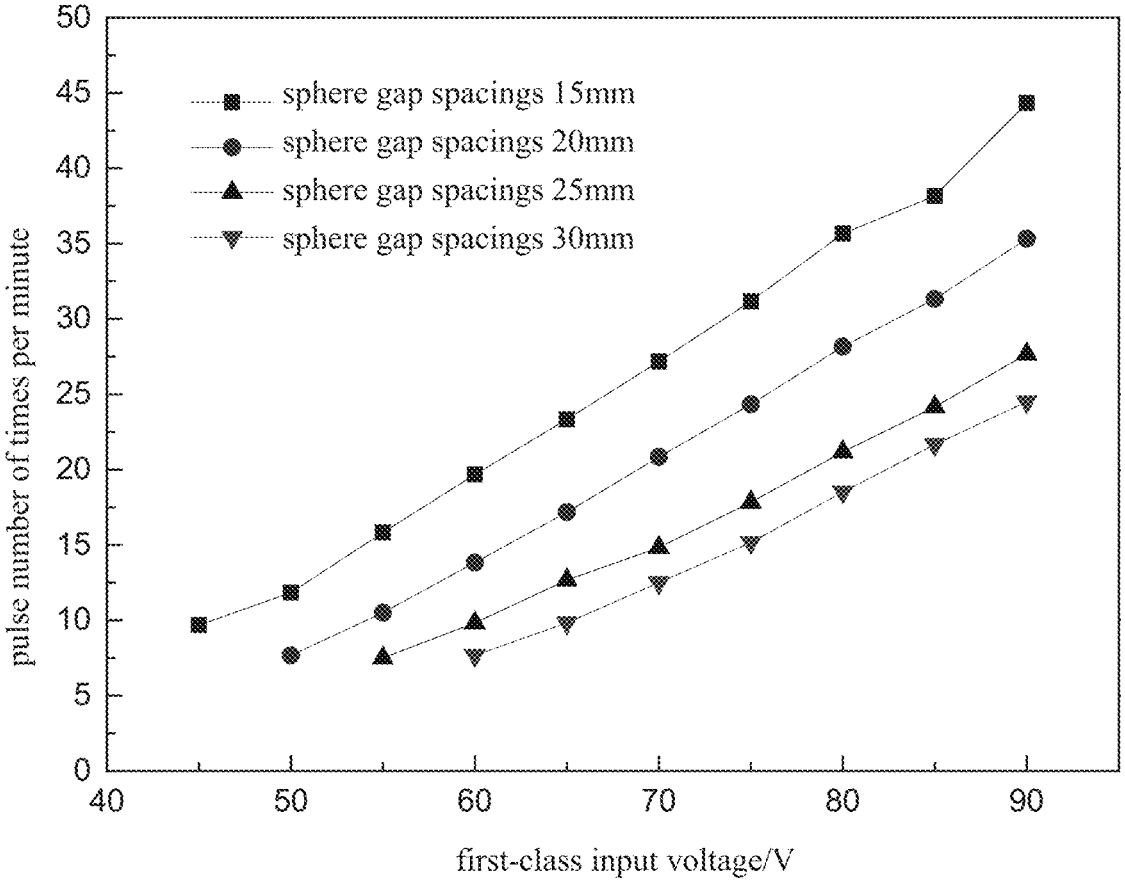
FIG. 7 is a curve chart of the first-class input voltage and the pulse number of times under the condition of different sphere gap spacings according to an embodiment of the present invention.

According to the embodiment of the present invention, the electric discharge period is changed along with first-class input voltage and the sphere gap spacings, the first-class input voltage is 45-90 V, the sphere gap spacing is 15-30 mm, the pulse number of times per minute is 5-45, and the electric discharge period is ⅕-1/45 min, as shown in FIG. 7.

Figure 8:
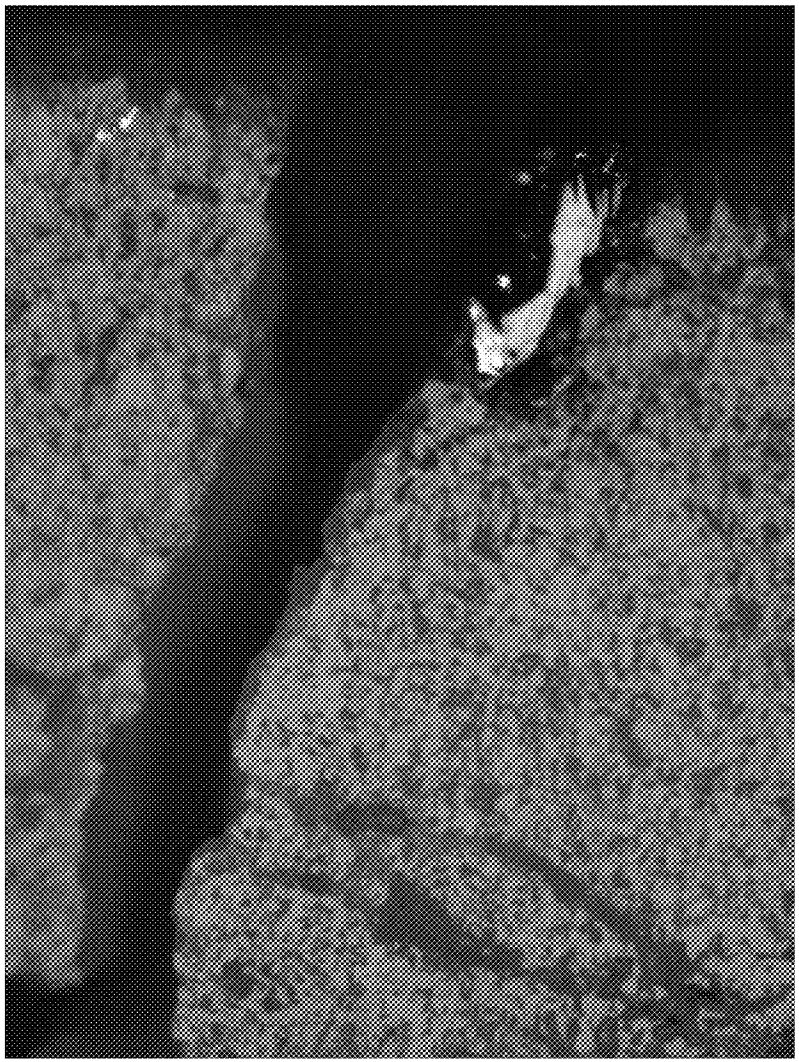
FIG. 8 is a photograph diagram showing surface cracks when materials treated by high-voltage electric pulse are amplified by 200 times according to an embodiment of the present invention.

According to the embodiment of the present invention, the surfaces of the materials after being treated by high-voltage electric pulse are amplified by 200 times are as shown in FIG. 8.

Embodiment 1

The high-voltage electric pulse device for crushing pre-treatment of ores is shown as FIG. 1, and comprises an ore feeding bin 1, a pulse insulating barrel body 2, a supporting frame 3, a pulsation device 5, a product collector 6 and a power supply 9. An upper part of the pulse insulating barrel body 2 is in a shape of a cylinder, a lower part of the pulse insulating barrel body 2 is in a shape of an inverted truncated cone, a cover plate 12 is arranged at a top portion of the pulse insulating barrel body 2, and a channel is arranged on the cover plate 12 to communicate with the ore feeding bin 1. The supporting frame 3 is sleeved on a side wall of the pulse insulating barrel body 2, and a bottom portion of the pulse insulating barrel body 2 and the pulsation device 5 are assembled together.

Figure 3:
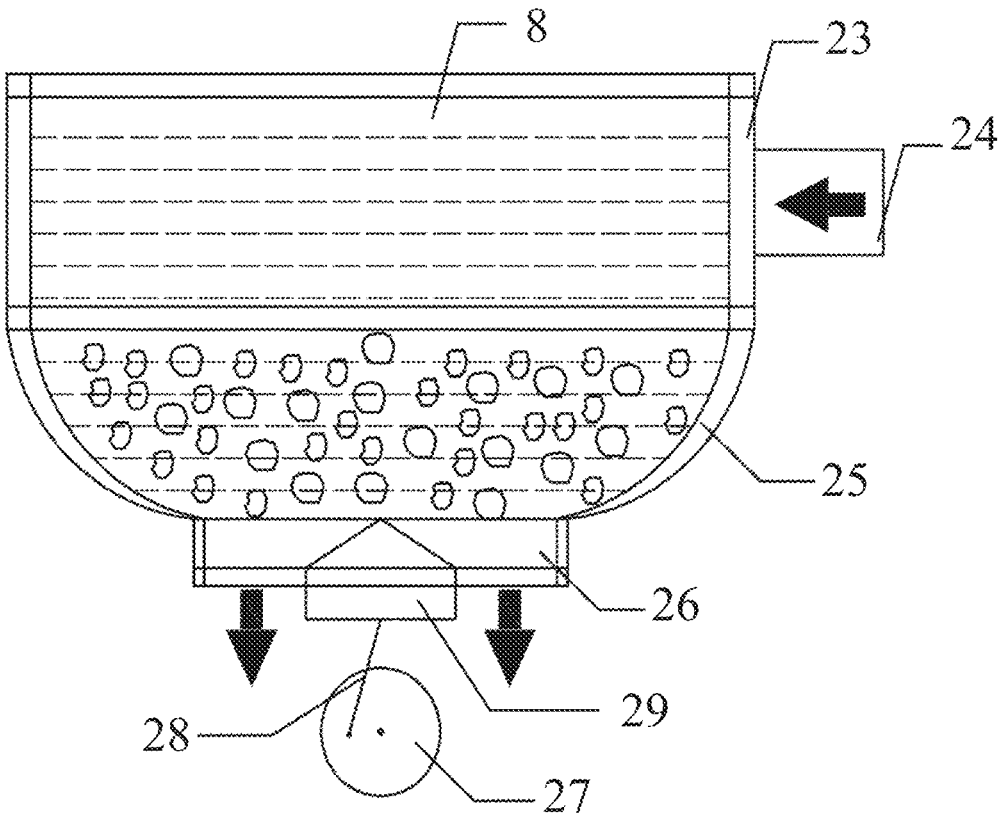
FIG. 3 is a structural schematic diagram illustrating a pulsation device according to an embodiment of the present invention.

The structure of the pulsation device 5 is shown in FIG. 3, and the pulsation device 5 consists of a pulsation insulating barrel body 23, an actuating diaphragm 25, an ore discharging outlet 26, a pulsation cone 29, a connecting rod 28 and an eccentric wheel 27. A water inlet 24 is formed in a side wall of the pulsation insulating barrel body 23 to communicate with a water outlet of a water pump 7, a bottom portion of the pulsation insulating barrel body 23 is connected with a top portion of the actuating diaphragm 25, a bottom portion of the actuating diaphragm 25 is connected with the ore discharging outlet 26, the pulsation cone 29 is arranged in the ore discharging outlet 26, a bottom portion of the pulsation cone 29 is hinged to one end of the connecting rod 28, the other end of the connecting rod 28 is hinged to the eccentric wheel 27, and the eccentric wheel 27 is driven by a motor (not shown).

The actuating diaphragm 25 is made of rubber.

Figure 4:
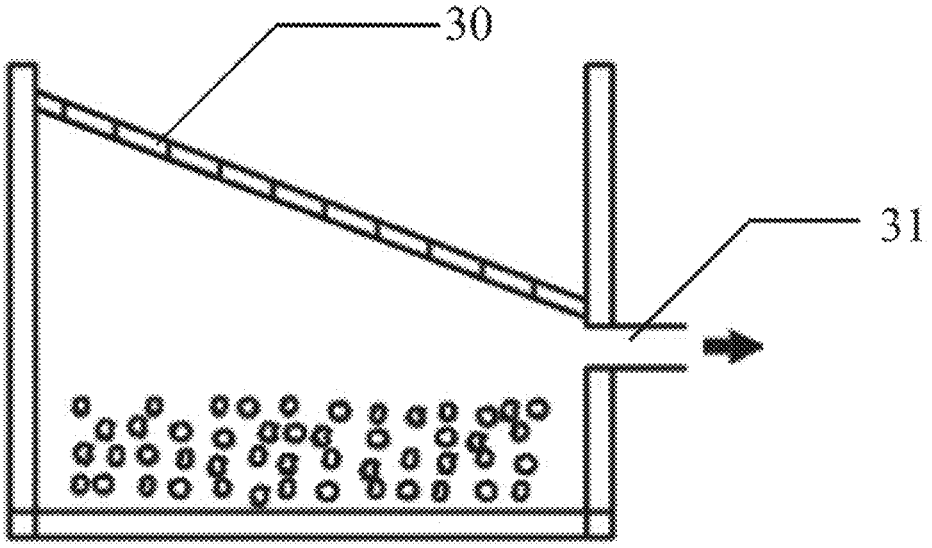
FIG. 4 is a structural schematic diagram illustrating a product collector in the FIG. 1.

The ore discharging outlet 26 communicates with a feeding inlet of the product collector 6, the structure of the product collector 6 is shown in FIG. 4, and a water outlet 31 is formed in a side wall of the product collector 6.

Figure 2:
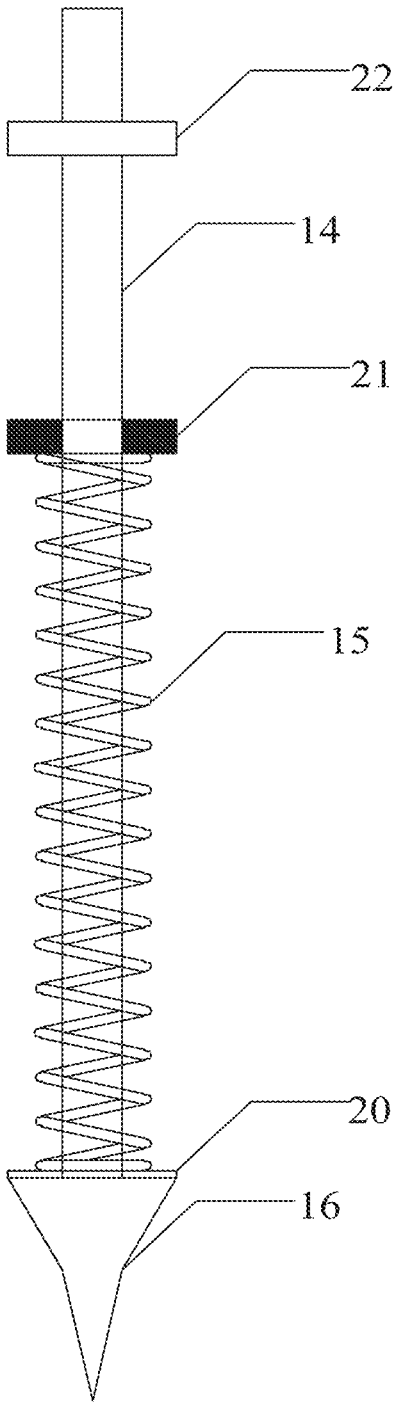
FIG. 2 is a structural schematic diagram illustrating the expanding and contracting devices according to an embodiment of the present invention.

A plurality of expanding and contracting devices are arranged on the cover plate 12, the structure of each expanding and contracting device is shown in FIG. 2, and each expanding and contracting device consists of a copper bar 14, a high-voltage electrode 16, an upper fixing block 22, a lower fixing block 21 and a spring 15, each upper fixing block 22 is fixedly connected to an upper part of the corresponding copper bar 14, the lower fixing blocks 21 are fixed to the cover plate 12, each copper bar 14 penetrates through the corresponding lower fixing block 21 and is in sliding and sealing connection with the corresponding lower fixing block 21, each high-voltage electrode 16 is fixedly connected with a bottom portion of the corresponding copper bar 14, a top end of each spring 15 is fixedly connected with the corresponding lower fixing block 21, a bottom end of each spring 15 is fixedly connected with the corresponding high-voltage electrode 16, and each spring 15 surrounds an outer part of the corresponding copper bar 14.

The copper bars 14 of the expanding and contracting devices are connected to two sets of high-voltage ceramic capacitors 11 in parallel through high-voltage wires 13, the high-voltage ceramic capacitors 11 and an alternate-current ignition transformer 10 are assembled together, and the alternate-current ignition transformer 10 and the power supply 9 are assembled together through a one-way voltage regulator 19.

Figure 6:
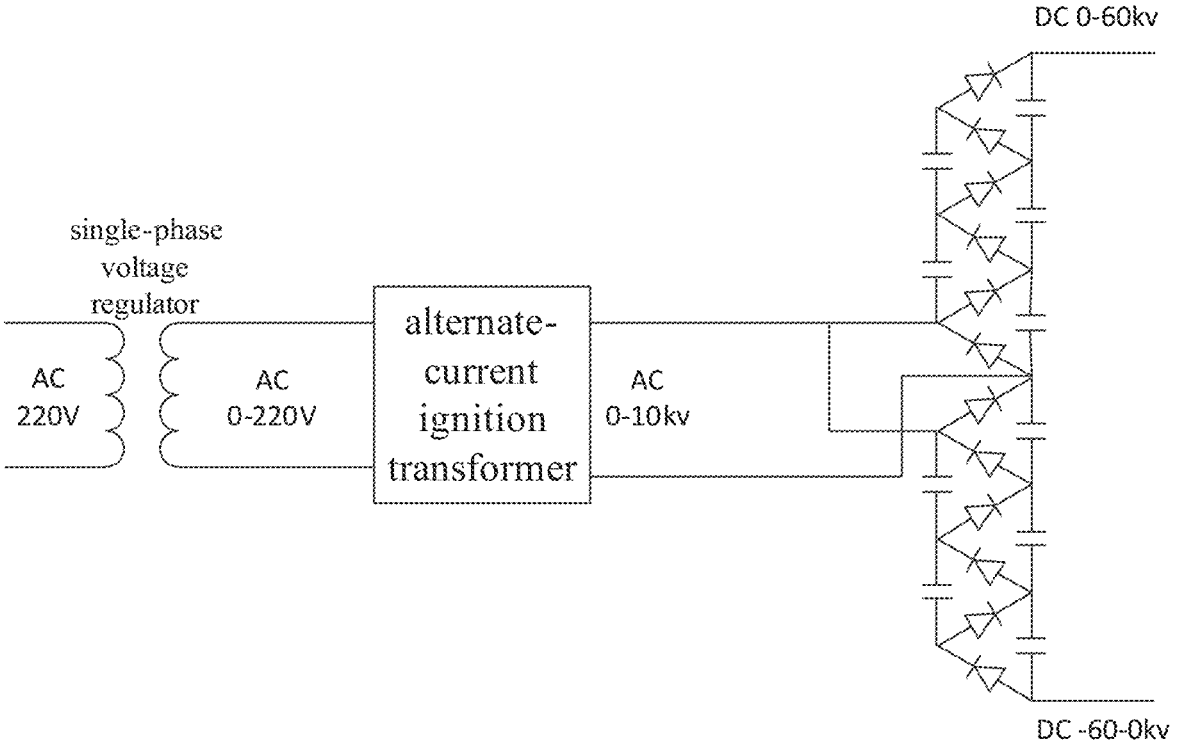
FIG. 6 is a circuit schematic diagram illustrating parts of high-voltage ceramic capacitors and an alternate-current ignition transformer in FIG. 1.

Circuits of the high-voltage ceramic capacitors 11 and the alternate-current ignition transformer 10 are shown in FIG. 6; four high-voltage ceramic capacitors exist in each set for two sets of the high-voltage ceramic capacitors 11; the power supply 9 is subjected to voltage transformation through the single-phase voltage regulator 19, voltage boosting through the alternate-current ignition transformer 10 and rectification and voltage boosting through the voltage sextuple rectifying circuits of the high voltage ceramic capacitors 11, and high-voltage direct currents are outputted to charge the high-voltage ceramic capacitors 11, wherein the rising time of the charging voltage is in the level of microseconds; after the voltage of each high-voltage ceramic capacitors 11 achieves the level that a gas switch (not shown) is conducted, the high-voltage electric pulse of which the rising time is in the level of nanoseconds is outputted, and is loaded to copper bars 14 through the high-voltage wires 13 and is conducted to the high-voltage electrodes 16.

A ground electrode 4 is fixedly connected to a bottom end of the pulse insulating barrel body 2, and penetrates through the supporting frame 3 to be earthed.

Figure 5:
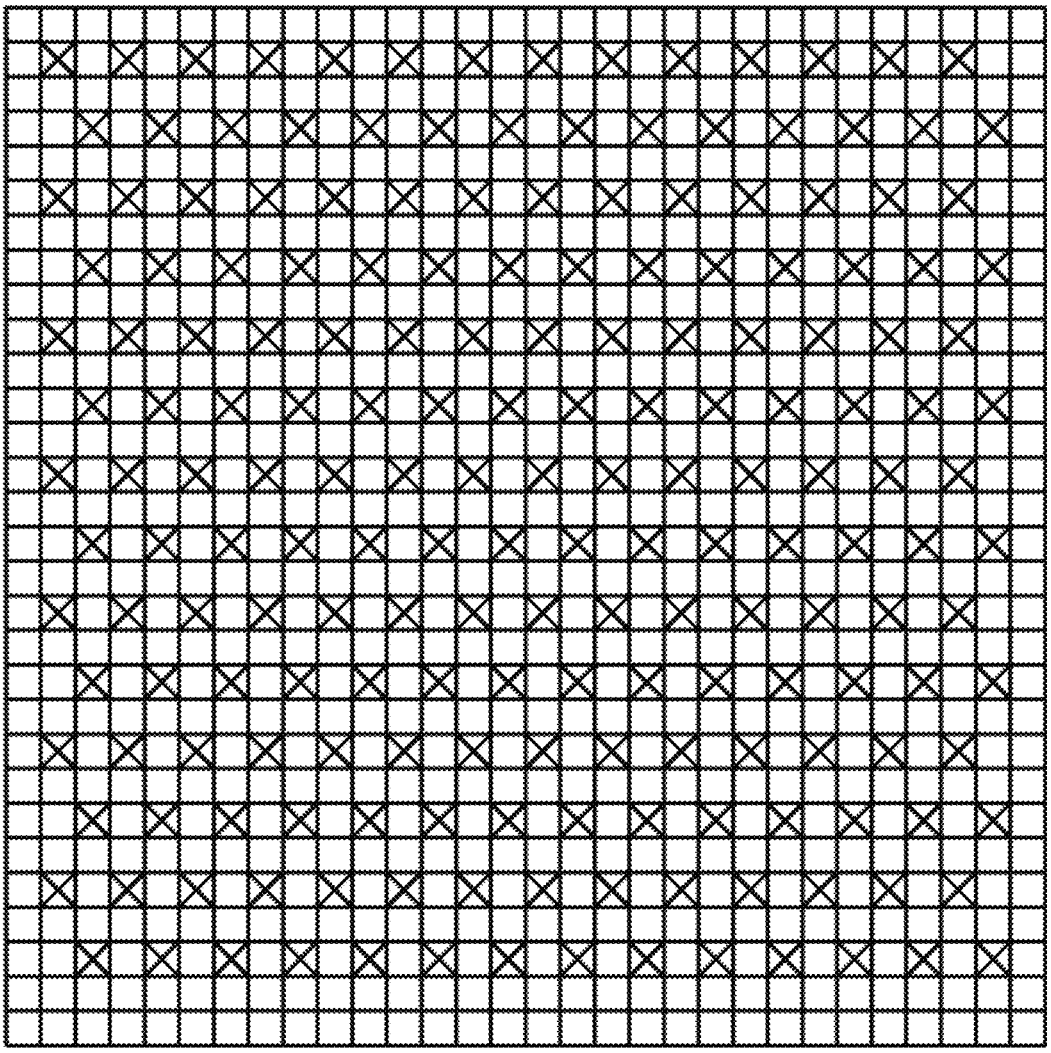
FIG. 5 is a top view of a screen cloth in FIG. 1 (parts marked with X are positions where the high-voltage negative poles are located)

A screen cloth 18 is fixedly mounted at a bottom end of the cylinder-shaped upper part of the pulse insulating barrel body 2, a plurality of high-voltage negative poles 17 are mounted on the screen cloth 18, and the structure is shown in FIG. 5.

A central axis of the eccentric wheel 27 and the motor are assembled together, and a position where the connecting rod 28 is hinged to the eccentric wheel 27 is located at a part except the central axis.

A water inlet of the water pump 7 communicates with a water outlet of a water tank, a water inlet of the water tank communicates with the water outlet 31 in the side wall of the product collector 6, and water is stuffed into the water tank as the insulating liquid 8.

The ores are raw ores from a certain lead ore dressing plant in Liaoning, and chemical components in the ores are as shown in a table 1 in percentage by mass:

TABLE 1

| Elements | Pb | Ag* | Au* | Cu | Zn | TFe | S |
|---|---|---|---|---|---|---|---|
| Content | 4.38 | 115.7 | 0.37 | 0.035 | <0.01 | 8.20 | 11.10 |
| Elements | As | $SiO_2$ | $Al_2O_3$ | CaO | MgO | K | Na |
| Content | 0.078 | 16.18 | 3.42 | 18.55 | 13.42 | 0.97 | 0.05 |

As shown in the table 1, lead and silver in the ores are main valuable elements, gold and sulfur can be considered to be comprehensively recovered, and the content of a hazardous element namely arsenic is low; the raw ores are subjected to X ray diffraction analysis to find out the main mineral composition of ore samples; and main minerals in the raw ores include components in percentage by mass of 5.12% of galena, 17.44% of pyrite, 57.66% of dolomite and 11.23% of quartz.

A method comprises the steps that:

step 1: the water pump 7 is started, so that water continuously enters the pulsation insulating barrel body 23 of the pulsation device 5 and is continuously drained from the water outlet of the product collector 6, the pulsation insulating barrel body 23 and the product collector 6 are full of the water which is used as insulating liquid 8, and the liquid level is higher than a bottom end of the high-voltage electrodes 16;

step 2: the ores are placed in the ore feeding bin 1 and are conveyed into the pulse insulating barrel body 2 through the ore feeding bin 1, the ores are accumulated on the screen cloth 18, and the ores at the top are in contact with the high-voltage electrodes 16;

step 3: the power supply 9 is switched on, electric currents are subjected to voltage transformation through the single-phase voltage regulator 19, voltage boosting through the alternate-current ignition transformer 10 and rectification and voltage boosting through voltage sextuple rectifying circuits of the high voltage ceramic capacitors 11, then high-voltage direct currents are outputted to charge high-voltage ceramic capacitors 11, after the voltage of the high-voltage ceramic capacitors 11 reaches a breakdown voltage value, the gas switch connected with the high-voltage ceramic capacitors 11 is conducted, high-voltage electric pulse is outputted, is loaded to copper bars 14 through high-voltage wires 13 and is conducted to the high-voltage electrodes 16, and an instantaneous high-voltage electric field is formed between the high-voltage electrodes 16 and the high-voltage negative poles 17; when the voltage of the high-voltage electrodes 16 reaches to the breakdown voltage value, electric discharge is caused between the high-voltage electrodes 16 and the high-voltage negative poles 17, and the ores are crushed; when the voltage of the high-voltage electrodes 16 reaches the breakdown voltage value once again, next-time electric discharge is formed; and when the hole diameter of granules of the crushed ores are smaller than that of the screen cloth 18, the crushed ores enter the pulsation device 5 through the screen cloth 18;

step 4: the eccentric wheel 27 is driven by the motor to rotate, so that the pulsation cone 29 moves up and down periodically; when the pulsation cone 29 moves upwards, ascending water currents are formed in the pulsation device 5, and when the pulsation cone 29 moves downwards, descending water currents are formed in the pulsation device 5; and under the action of ascending and descending of the water currents on the ores on the screen cloth 18, the part of the ores being small and medium in granules on the screen cloth 18 can gradually move downwards; and step 5: the crushed ores enter the product collector 6 through the pulsation device 5.

Along with discharge of the crushed ores from the screen cloth 18, the ores on the screen cloth 18 are gradually reduced; each high-voltage electrode 16 is gradually declined under the action of the elasticity of the corresponding spring 15 until the corresponding upper fixing block 22 is in contact with the corresponding lower fixing block 21, at this moment, a gap is formed between each high-voltage electrode 16 and the corresponding high-voltage negative pole 17, and short circuit is avoided.

The time interval of electric discharge for two close times is an electric discharge period, and the pulsation cone 29 moves up and down once to form a pulsation period; through adjusting the rotational speed of the motor, the pulsation period is controlled to be equal to the positive integer times of the electric discharge period; and the electric discharge period is changed along with first-class input voltage and sphere gap spacing, wherein the first-class input voltage is 45-90 V, the sphere gap spacing is 15-30 mm, the pulse number of times per minute is 5-45, and the electric discharge period is ⅕-¼₅ min.

The voltage of the power supply 9 is 220 V, and the frequency of the power supply 9 is 50 Hz.

A pulse power supply consists of the single-phase voltage regulator 19, the alternate-current ignition transformer 10 and the high-voltage ceramic capacitors 11 and is used for outputting electrical pulse, the rising time of the electrical pulse is 50 ns-500 ns, and the rising time is the time that pulse forms wave shapes.

The high-voltage negative poles 17 are uniformly distributed on the screen cloth 18 and are used for improving electric crushing efficiency and strengthening crushing effects.

The breakdown voltage value is 20 kV.

The pulse strength of the high-voltage electric pulse is 60 kV, and the pulse frequency is 15 Hz.

The time that the ores are treated by the high-voltage electric pulse is 10 min, then the pretreated ores are taken out, the pretreated ores are crushed to 2 mm or below with a disk crusher (not shown), the crushed products are subjected to division, 50 g of ore samples are sampled, during ore grinding, the mass concentration of ore pulp is adjusted to 70%, under the condition that the ore grinding time is 3 min, ore grinding is performed with a barrel type rod grinding machine (not shown), and pretreated samples are obtained.

Besides, under the situation that the same raw ores are not subjected to high-voltage electric pulse treatment, ore grinding is performed in the same manner, and standard samples are obtained as a contrast test.

The pretreated samples and the standard samples are subjected to granularity screen analysis experiment and monomer dissociation determination, and the result is shown in a table 2 (in percentage by mass, difference value=standard sample value-pretreated sample value).

TABLE 2

| granularity/ mm | granularity yield/% standard samples | pretreated samples | difference value | monomer dissociation /% standard samples | pretreated samples | difference value |
|---|---|---|---|---|---|---|
| +0.074 | 66.37 | 42.66 | 23.71 | 18.89 | 38.22 | −19.33 |
| −0.074 + 0.043 | 15.34 | 24.45 | −9.11 | 28.94 | 45.78 | −16.84 |
| −0.043 + 0.038 | 5.88 | 6.34 | −0.46 | 27.76 | 55.65 | −27.89 |
| −0.038 | 12.41 | 26.55 | −14.14 | 24.44 | 43.89 | −19.45 |
| Total | 100 | 100 | | 21.64 | 42.68 | −21.04 |

Compared with the standard samples, in the pretreated samples, the content of the ores of the granularity being+0.074 mm is reduced by 23.71%, the content of the ores of the granularity being −0.074+0.043 mm is raised by 9.11%, the content of the ores of the granularity being −0.043+0.038 mm is raised by 0.46%, and the content of the ores of the granularity being −0.038 mm is raised by 14.14%; after the raw ores are subjected to high-voltage electric pulse pretreatment, the monomer dissociation of the useful minerals in the ore grinding products is totally increased by 21.04%; and therefore, after a high-voltage electric pulse pretreatment technique is applied to galena comminution work, the monomer dissociation is increased, and the ore grinding efficiency is improved.

Embodiment 2

The device is the same as that in the embodiment 1.

The ores are raw ores from a certain tungsten mine in Jiangxi, and chemical components in the ores are shown in a table 3 in percentage by mass:

TABLE 3

| Elements | $WO_3$ | Cu | Sn | Mo | Pb | Zn | S |
|---|---|---|---|---|---|---|---|
| Content | 0.27 | 0.09 | 0.03 | 0.003 | 0.017 | 0.016 | 0.17 |
| Elements | P | $SiO_2$ | $Al_2O_3$ | CaO | MgO | $TiO_2$ | Fe |
| Content | 0.07 | 69.86 | 13.85 | 2.41 | 2.08 | 0.69 | 3.02 |
| Elements | $K_2O$ | $Na_2O$ | MnO | As | S | | |
| Content | 3.73 | 1.19 | 0.57 | 0.004 | 0.16 | | |

As seen in the table 3, useful elements include tungsten, copper and molybdenum, main elements in the gangue minerals include silicon, magnesium and aluminum, tungsten phase analysis indicates that mainly 79.52% of scheelite and 18.59% of wolframite are recovered from the minerals, extremely little tungstite is contained, and the occupation ratio of the tungstite is 1.89%.

Compared with the embodiment 1, the method is characterized in that:

The pulse strength of the high-voltage electric pulse is 80 kV, and the pulse frequency is 25 Hz.

The time that the ores are treated by the high-voltage electric pulse is 5 min, then the pretreated ores are taken out, the pretreated ores are crushed to 2 mm or below with a disk crusher (not shown), the crushed products are subjected to division, 100 g of ore samples are sampled, during ore grinding, the mass concentration of ore pulp is adjusted to 60%, under the condition that the ore grinding time is 2 min, ore grinding is performed with a barrel type rod grinding machine (not shown), and pretreated samples are obtained.

Besides, under the situation that the same raw ores are not subjected to high-voltage electric pulse treatment, ore grinding is performed in the same manner, and standard samples are obtained as a contrast test.

The pretreated samples and the standard samples are subjected to granularity screen analysis experiment and monomer dissociation determination, and the results are shown in Table 4.

TABLE 4

| granularity/ mm | granularity yield/% standard samples | pretreated samples | difference value | monomer dissociation /% standard samples | pretreated samples | difference value |
|---|---|---|---|---|---|---|
| +0.074 | 45.23 | 34.22 | 11.01 | 11.21 | 38.22 | −27.01 |
| −0.074 + 0.043 | 23.43 | 24.45 | −1.02 | 23.45 | 45.78 | −22.33 |
| −0.043 + 0.038 | 5.88 | 27.12 | −21.24 | 21.47 | 59.45 | −37.98 |
| −0.038 | 25.46 | 14.21 | 11.25 | 18.54 | 32.45 | −13.91 |
| Total | 100 | 100 | | 16.55 | 45.01 | −28.46 |

Compared with the standard samples, in the pretreated samples, the content of the ores of the granularity being+0.074 mm is reduced by 11.01%, the content of the ores of the granularity being −0.074+0.043 mm is raised by 1.02%, the content of the ores of the granularity being −0.043+0.038 mm is raised by 21.24%, and the content of the ores of the granularity being −0.038 mm is reduced by 11.25%; after the raw ores are subjected to high-voltage electric pulse pretreatment, the monomer dissociation of the useful minerals in the ore grinding products is totally increased by 28.46%; therefore, under the premise that the monomer dissociation is increased, the yield of the ores of fine granularity is also effectively reduced, and recovery treatment of subsequent flotation is facilitated; and after a high-voltage electric pulse pretreatment technique is applied to scheelite comminution work, the monomer dissociation is increased, and the ore grinding efficiency is improved.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A high-voltage electric pulse device for crushing pretreatment of ores, comprising an ore feeding bin, a pulse insulating barrel body, a supporting frame, a pulsation device, a product collector and a power supply;

wherein an upper part of the pulse insulating barrel body is in a shape of a cylinder, a lower part of the pulse insulating barrel body is in a shape of an inverted truncated cone, a cover plate is arranged at a top portion of the pulse insulating barrel body, and a channel is arranged on the cover plate to communicate with the ore feeding bin;

wherein the supporting frame is sleeved on a side wall of the pulse insulating barrel body, and a bottom portion of the pulse insulating barrel body and the pulsation device are assembled together;

wherein the pulsation device consists of a pulsation insulating barrel body, an actuating diaphragm, an ore discharging outlet, a pulsation cone, a connecting rod and an eccentric wheel, wherein a water inlet is formed in a side wall of the pulsation insulating barrel body and communicates with a water pump, a bottom portion of the pulsation insulating barrel body is connected with a top portion of the actuating diaphragm, a bottom portion of the actuating diaphragm is connected with the ore discharging outlet, the pulsation cone is arranged in the ore discharging outlet, a bottom portion of the pulsation cone is hinged to one end of the connecting rod, the other end of the connecting rod is hinged to the eccentric wheel, the eccentric wheel is driven by a motor, and the actuating diaphragm is made of rubber; the ore discharging outlet communicates with a feeding inlet of the product collector, and a water outlet is formed in a side wall of the product collector;

wherein a plurality of expanding and contracting devices are arranged on the cover plate, wherein each expanding and contracting device consists of a copper bar, a high-voltage electrode, an upper fixing block, a lower fixing block and a spring, each upper fixing block is fixedly connected to an upper part of the corresponding copper bar, the lower fixing blocks are fixed to the cover plate, each copper bar penetrates through the corresponding lower fixing block and is in sliding and sealing connection with the corresponding lower fixing block, each high-voltage electrode is fixedly connected with a bottom portion of the corresponding copper bar, a top end of each spring is fixedly connected with the corresponding lower fixing block, a bottom end of each spring is fixedly connected with the corresponding high-voltage electrode, and each spring surrounds an outer part of the corresponding copper bar;

wherein the copper bars of the expanding and contracting devices are connected to two sets of high-voltage ceramic capacitors in parallel through high-voltage wires, the high-voltage ceramic capacitors and an alternate-current ignition transformer are assembled together, and the alternate-current ignition transformer and the power supply are assembled together through a one-way voltage regulator;

wherein a ground electrode is fixedly connected to a bottom end of the pulse insulating barrel body, and penetrates through the supporting frame to be earthed; and wherein a screen cloth is fixedly mounted at a bottom end of the cylinder-shaped upper part of the pulse insulating barrel body, and a plurality of high-voltage negative poles are mounted on the screen cloth.

2. The high-voltage electric pulse device for crushing pretreatment of ores according to claim 1, wherein a central axis of the eccentric wheel and the motor are assembled together, and a position where the connecting rod is hinged to the eccentric wheel is located at a part except the central axis.

3. The high-voltage electric pulse device for crushing pretreatment of ores according to claim 1, wherein a water inlet of the water pump communicates with a water outlet of a water tank, and a water inlet of the water tank communicates with the water outlet in the side wall of the product collector.

4. The high-voltage electric pulse device for crushing pretreatment of ores according to claim 1, wherein the screen cloth is made of stainless steel, and a hole diameter of the screen cloth is 2-10 mm.

5. The high-voltage electric pulse device for crushing pretreatment of ores according to claim 1, wherein the pulse insulating barrel body is made of PVC, and the supporting frame and the cover plate are made of stainless steel.

6. The high-voltage electric pulse device for crushing pretreatment of ores according to claim 1, wherein the high-voltage electrodes and the high-voltage negative poles are made of stainless steel, the high-voltage electrodes are in a shape of an inverted cone, and the high-voltage negative poles are in a shape of a cone.

7. The high-voltage electric pulse device for crushing pretreatment of ores according to claim 1, wherein the lower fixing blocks and the cover plate are insulated through insulating washers.

8. The high-voltage electric pulse device for crushing pretreatment of ores according to claim 1, wherein an inclined screen cloth is arranged in the product collector, an inclined angle between the inclined screen cloth and a level surface is 20-40 degrees, the inclined screen cloth is located above the water outlet in the side wall of the product collector, and a hole diameter of the inclined screen cloth is 2-10 mm.

9. The high-voltage electric pulse device for crushing pretreatment of ores according to claim 1, wherein the pulsation insulating barrel body is made of PVC.

10. The high-voltage electric pulse device for crushing pretreatment of ores according to claim 1, wherein the springs are compression springs, and a length of each spring under a natural state is greater than a distance between each high-voltage electrode and the corresponding lower fixing block.

* * * * *